US011285085B2

(12) United States Patent
Lorentz et al.

(10) Patent No.: US 11,285,085 B2
(45) Date of Patent: Mar. 29, 2022

(54) GASTROINTESTINAL FEEDING TUBES WITH ENHANCED SKIN SURFACE BUMPERS

(71) Applicant: Mayo Foundation for Medical Education and Research, Rochester, MN (US)

(72) Inventors: Paul A. Lorentz, Rochester, MN (US); Manpreet S. Mundi, Rochester, MN (US); Drew J. Smith, Rochester, MN (US); Stephen M. Corner, Rochester, MN (US)

(73) Assignee: Mayo Foundation for Medical Education and Research, Rochester, MN (US)

( * ) Notice: Subject to any disclaimer, the term of this patent is extended or adjusted under 35 U.S.C. 154(b) by 279 days.

(21) Appl. No.: 16/780,450

(22) Filed: Feb. 3, 2020

(65) Prior Publication Data

US 2020/0170891 A1 Jun. 4, 2020

Related U.S. Application Data

(62) Division of application No. 15/470,532, filed on Mar. 27, 2017, now Pat. No. 10,588,827.

(60) Provisional application No. 62/319,071, filed on Apr. 6, 2016.

(51) Int. Cl.
*A61J 15/00* (2006.01)

(52) U.S. Cl.
CPC ..... *A61J 15/0015* (2013.01); *A61J 15/0034* (2013.01); *A61J 15/0042* (2013.01); *A61J 15/0061* (2013.01); *A61J 15/0088* (2015.05); *A61J 2200/70* (2013.01)

(58) Field of Classification Search
CPC ..... A61J 15/0015; A61J 15/0061; A61J 15/0049; A61J 15/0034; A61J 15/003; A61J 15/0053; A61M 25/02; A61M 2025/0233; A61B 2562/0261; A61B 2090/065; G01L 5/009; G01L 1/005
See application file for complete search history.

(56) References Cited

U.S. PATENT DOCUMENTS 4,666,433 A 5/1987 Parks
4,944,732 A 7/1990 Russo
(Continued)

OTHER PUBLICATIONS

Brown et al., "Nutrition During and After Cancer Treatment: A Guide* for Informed Choices by Cancer Survivors," CA Cancer J. Clin., 51(3):153-181, quiz 189-92, May-Jun. 2001.
(Continued)

*Primary Examiner* — Laura A Bouchelle
(74) *Attorney, Agent, or Firm* — Fish & Richardson P.C.

(57) ABSTRACT

Gastric and intestinal feeding tube devices and methods can be enhanced to provide better patient outcomes. For example, this document provides gastric and intestinal feeding tube devices that include an external bumper with pressure sensors and pressure indicators that facilitate usage of the feeding tube devices within an appropriate range of skin surface pressure. This document also provides external bumpers with deflectable elements that facilitate the application of a controlled amount of force between the external bumpers and the skin surface.

15 Claims, 6 Drawing Sheets

(56) References Cited

U.S. PATENT DOCUMENTS

| | | | | |
|---|---|---|---|---|
| 5,267,968 | A * | 12/1993 | Russo | A61M 25/02 604/174 |
| 5,358,488 | A | 10/1994 | Suriyapa | |
| 6,030,361 | A * | 2/2000 | Miyashiro | A61J 15/0015 604/523 |
| 6,978,678 | B2 | 12/2005 | Lohmeier et al. | |
| 7,240,570 | B2 * | 7/2007 | McDearmon | F16C 19/522 73/862.322 |
| 7,699,817 | B2 | 4/2010 | Adams | |
| 8,142,394 | B1 | 3/2012 | Rotella et al. | |
| 10,512,431 | B2 * | 12/2019 | Cheng | A61B 5/6833 |
| 2017/0290744 | A1 | 10/2017 | Lorentz et al. | |

OTHER PUBLICATIONS

Cabre et al., "Effect of total enteral nutrition on the short-term outcome of severely malnourished cirrhotics. A randomized controlled trial," Gastroenterology., 98(3):715-720, Mar. 1990.

Callahan et al., "Healthcare costs associated with percutaneous endoscopic gastrostomy among older adults in a defined community," J Am Geriatr Soc., 49(11):1525-1529, Nov. 2001.

Dávalos et al., "Effect of Malnutrition After Acute Stroke on Clinical Outcome," Stroke., 27:1028-1032, 1996.

DeLegge et al., "External bolster placement after percutaneous endoscopic gastrostomy tube insertion: is looser better?" J Parenter Enteral Nutr., 30(1):16-20, Jan.-Feb. 2006.

DeLegge et al., "Gastrostomy tubes: Complications and their management," Oct. 7, 2014, Accessed Jan. 29, 2018, Accessed online: URL<http://www.uptodate.com/contents/gastrostomy-tubes-complications-and-their-management, 11 pages.

Delegge., "Home Enteral Nutrition," J Parenter Enter Nutr., 26(5s):S4-S7, September 1, 2002v.

Groah et al., "Prevention of Pressure Ulcers Among People With Spinal Cord Injury: A Systematic Review," PM R., 7(6):613-636, Jun. 2015.

Hurt et al., "Blenderized Tube Feeding Use in Adult Home Enteral Nutrition Patients: A Cross-Sectional Study," Nutr Clin Pract., 30(6):824-829, Dec. 2015.

Jones et al., "Annual Bans Report: Artificial Nutrition Support in the UK 2000-2007," BAPEN., 2008, 43 pages.

Klein et al., "The "buried bumper syndrome": a complication of percutaneous endoscopic gastrostomy," Am J Gastroenterol., 85(4):448-451, Apr. 1990.

Lachter et al.,"Long-term use of percutaneous endoscopic gastrostomies: A survey of duration of use and level of maintenance," The Internet J Gastroenterology., 4(2), 2005, 6 pages.

Lockett et al., "Percutaneous endoscopic gastrostomy complications in a tertiary-care center," Am Surg., 68(2):117-120, Feb. 2002.

Lynch and Fang "Prevention and management of complications of percutaneous endoscopic gastronomy (PEG) tubes," Practical Gastroenterology., Nov. 2004, 9 pages.

MacLean et al., "Complications of percutaneous endoscopic and fluoroscopic gastrostomy tube insertion procedures in 378 patients," Gastroenterol Nurs., 30(5):337-341, Sep.-Oct. 2007.

McClave and Jafri., "Spectrum of morbidity related to bolster placement at time of percutaneous endoscopic gastrostomy: buried bumper syndrome to leakage and peritonitis," Gastrointest Endosc Clin N Am., 17(4):731-746, Oct. 2007.

Nutritioncare.org' [online] "Nutrition Support Patient Data," Retrieved on Jan. 29, 2018, Retrieved from: URL<http://www.nutritioncare.org/About_Clinical_Nutrition/Nutrition_Support_Patient_Data_Fact_Sheet/, 2 pages.

Orrevall et al., "A National Observational Study of the Prevalence and Use of Enteral Tube Feeding, Parenteral Nutrition and Intravenous Glucose in Cancer Patients Enrolled in Specialized Palliative Care," Nutrients., 5(1):267-282, Jan. 22, 2013.

Ponsky and Gauderer., "Percutaneous endoscopic gastrostomy: a nonoperative technique for feeding gastrostomy," Gastrointest Endosc., 27(1):9-11, Feb. 1981.

Reddy and Malone., "Cost and outcome analysis of home parenteral and enteral nutrition," JPEN J Parenter Enteral Nutr., 22(5):302-310, Sep.-Oct. 1998.

Reger et al., "Support surface interface pressure, microenvironment, and the prevalence of pressure ulcers: an analysis of the literature," Ostomy Wound Manage., 53(10):50-58, Review, Oct. 2007.

Schrag et al., "Complications related to percutaneous endoscopic gastrostomy (PEG) tubes. A comprehensive clinical review," J Gastrointestin Liver Dis., 16(4):407-418, 2007.

Somanchi et al., "The Facilitated Early Enteral and Dietary Management Effectiveness Trial in Hospitalized Patients With Malnutrition," J Parenter Enter Nutr., 35(2):209-216, Mar. 4, 2011.

Swain and Bader, "The measurement of interface pressure and its role in soft tissue breakdown," J Tissue Viability., 12(4):132-146, Oct. 2002.

Tsai and Lin., "Clinical manifestations and management of buried bumper syndrome in patients with percutaneous endoscopic gastrostomy," Gastrointest Endosc., 69(6):1193-1194, May 2009.

Unsal et al., "Evaluation of nutritional status in cancer patients receiving radiotherapy: a prospective study," Am J Clin Oncol., 29(2):183-188, Apr. 2006.

Walton et al., "Complications of percutaneous gastrostomy in patients with head and neck cancer—an analysis of 42 consecutive patients," Ann R Coll Surg Engl., 81:272-276, 1999.

* cited by examiner

GASTROINTESTINAL FEEDING TUBES WITH ENHANCED SKIN SURFACE BUMPERS

CROSS-REFERENCE TO RELATED APPLICATIONS

This application is a divisional application of U.S. Ser. No. 15/470,532, filed Mar. 27, 2017, which application claims the benefit of U.S. Provisional Application Ser. No. 62/319,071, filed Apr. 6, 2016. The disclosures of the prior applications are considered part of (and are incorporated by reference in) the disclosure of this application.

BACKGROUND

1. Technical Field

This document relates to gastric and intestinal feeding tube devices and methods for their use. For example, this document relates to gastric and intestinal feeding tube devices that include an external bumper that is adapted to facilitate the application of a desired level of pressure from the external bumper onto the skin surface.

2. Background Information

Percutaneous endoscopic gastrostomy (PEG)/percutaneous endoscopic jejunostomy (PEJ) tubes have experienced a substantial rise in utilization since the first tube was placed in 1979. PEG/PEJ tubes deliver nutritional content directly to the stomach/intestine through a tube when a patient is unable to intake food orally. While use has greatly increased, the underlying technology has remained essentially unchanged over several decades.

The high level of PEG/PEJ use creates an overwhelming population of users who experience complications due to use, many of which negatively impact the patient's quality of life. Approximately 20-30% of patients on feeding tubes experience skin breakdown, inflammation, infection, and/or discharge by the time a tube is regularly replaced after about 6-8 months of usage. These problems can be attributed to the long-term placement of the external bumper. Other complications, including hemorrhage (about 2.5%) and Buried Bumper Syndrome (about 0.3-2.4%) have also been shown to be correlated with the pressure applied at the site of tube insertion in the abdomen. With approximately 200,000 feeding tubes placed in the United States each year, an externally located, PEG/PEJ feedback system is needed in order to prevent placement-related complications before they arise.

SUMMARY

This document describes gastric and intestinal feeding tube devices and methods for their use. For example, this document describes gastric and intestinal feeding tube devices that include an external bumper that is adapted to facilitate the application of a desired level of pressure from the external bumper onto the skin surface. In some embodiments, the external bumpers described herein are equipped with pressure sensors and pressure indicators that facilitate usage of the feeding tube devices within an appropriate range of skin surface pressure. In some embodiments, the external bumpers described herein are designed to exert an appropriate range of skin surface pressure when configured in a deflected, or spring-loaded state.

While the inventive concepts are described herein in the context of feeding tube devices, it should be understood that the concepts can also be used for devices such as venting tubes, catheters, drainage tubes, and the like.

In one implementation, a percutaneous feeding tube device includes: an elongate tube; a bulbous inner bumper disposed around a portion of the tube and configured for contact with a tissue surface of a gastrointestinal system; a connector coupled to a proximal end of the tube; and an outer bumper slidably coupled to the tube and disposed between the inner bumper and the connector. The outer bumper is configured for contact with an abdominal skin surface. The outer bumper comprises one or more pressure sensors for detecting pressure exerted by the outer bumper onto the abdominal skin surface.

Such a percutaneous feeding tube device may optionally include one or more of the following features. The inner bumper may be inflatable. The outer bumper also include a moisture detector. The outer bumper may also include one or more indicators. Each respective indicator of the one or more indicators may be configured for indicating a pressure detected by a respective pressure sensor of the one or more pressure sensors. The one or more indicators may each comprise a light source. The light source may be configured to indicate one or more of a high pressure, a low pressure, and a pressure within a target range. The outer bumper may also include a transmitter for wireless communications with an external computing system. The outer bumper may also include a battery powered control circuit.

In another implementation, an outer bumper for a percutaneous feeding tube device includes: a housing defining an internal space and a through-hole configured to slidably receive a feeding tube; control circuitry disposed within the internal space; and one or more pressure sensors coupled to the control circuitry for detecting pressure exerted by the outer bumper onto an abdominal skin surface.

Such an outer bumper may include one or more of the following features. The outer bumper may also include a silicone layer covering a portion of the housing and configured for contact with the abdominal skin surface. The outer bumper may also include one or more indicators. Each respective indicator of the one or more indicators may be configured for indicating a pressure detected by a respective pressure sensor of the one or more pressure sensors. The one or more indicators may each include a light source. The light source may be configured to indicate one or more of a high pressure, a low pressure, and a pressure within a target range. The outer bumper may also include a transmitter for wireless communications with an external computing system. The outer bumper may also include a moisture detector.

In another implementation, a method of operating a percutaneous feeding tube device that is coupled in an operative arrangement with a patient includes: receiving, by a controller circuit housed within an outer bumper of the feeding tube device, a pressure signal from a pressure detector (wherein the pressure signal is indicative of pressure exerted by the outer bumper onto an abdominal skin surface of the patient); comparing, by the controller circuit, the pressure signal to a first threshold pressure value; and providing an output, by the controller circuit, that is based on the comparison of the pressure signal to the first threshold pressure value.

Such a method of operating a percutaneous feeding tube may optionally include one or more of the following features. The output may be an electrical signal that is sent from the controller circuit to an indicator light. The first threshold pressure value may be an upper limit of an acceptable pressure range. The method may also include comparing, by the controller circuit, the pressure signal to a second threshold pressure value (wherein the second threshold pressure value may be a lower limit of the acceptable pressure range). The output may be indicative of whether the pressure signal is: (i) below the lower limit of the acceptable pressure range, (ii) above the upper limit of the acceptable pressure range, or (iii) within the acceptable pressure range.

In another aspect, this disclosure is directed to a percutaneous feeding tube device including: (i) an elongate tube; (ii) a bulbous inner bumper disposed around a portion of the tube and configured for contact with a tissue surface of a gastrointestinal system; (iii) a connector coupled to a proximal end of the tube; and (iv) an outer bumper disposed between the inner bumper and the connector. The outer bumper includes: (a) a central collar defining a hole in which the tube is slidably coupled; (b) a distal portion configured for contact with an abdominal skin surface; and (c) one or more deflectable elements extending between the central collar and the distal portion. The outer bumper is reconfigurable between a first configuration in which the one or more deflectable elements are in an un-deflected state and a second configuration in which the one or more deflectable elements are each bent in comparison to the un-deflected state.

Such a percutaneous feeding tube device may optionally include one or more of the following features. The one or more deflectable elements may be curved while in the un-deflected state. The one or more deflectable elements may have compound curves while in the un-deflected state. The distal portion may include a plurality of pads that include distal-most skin-contacting surfaces. The pads may be spaced apart from each other.

Particular embodiments of the subject matter described in this document can be implemented to realize one or more of the following advantages. In some embodiments, a portable, cost-effective external pressure sensor is provided which can be utilized by patients and their healthcare team (both inpatient and outpatient) in the management of long-term gastric and intestinal tubes. The pressure sensor(s) allows for the standardization and optimization of enteral tube adjustments, leading to fewer tube-related complications, with a concomitant reduction in associated direct and indirect costs (provider interventions, procedural interventions, reduced quality of life, reduced clinical access, etc.). Moreover, in some cases, there can be an on-going need for adjustment of the external skin disk based on changes in abdominal girth, body position, and so on. The devices and methods provided herein can advantageously facilitate prevention of skin-related issues such as, but not limited to, (1) skin breakdown from tube leaking (external skin disk too loose), (2) skin breakdown (external skin and abdominal wall tissue) from external skin disk being too tight, and (3) "buried bumper syndrome" (internal mushroom goes into abdominal wall as a result to the external skin disk being too tight). The vast majority of feeding tube patients are using these tubes at home (away from their clinical care team). Discharged patients calling from home, not certain if their external skin disk is too loose or too tight, are difficult for the care provider to diagnose over the phone. The devices and methods provided herein provide an easy-to-understand user interface that patients can advantageously use themselves to make appropriate adjustments to the external skin disk pressure, which can ultimately improve his or her outlook and quality of life.

Unless otherwise defined, all technical and scientific terms used herein have the same meaning as commonly understood by one of ordinary skill in the art to which this invention pertains. Although methods and materials similar or equivalent to those described herein can be used to practice the invention, suitable methods and materials are described herein. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description herein. Other features, objects, and advantages of the invention will be apparent from the description and drawings, and from the claims.

DESCRIPTION OF THE DRAWINGS

Like reference numbers represent corresponding parts throughout.

DETAILED DESCRIPTION

This document describes gastric and intestinal feeding tube devices and methods for their use. For example, this document describes gastric and intestinal feeding tube devices that include an external bumper that is adapted to facilitate the application of a desired level of pressure from the external bumper onto the skin surface. While the inventive concepts are described herein in the context of feeding tube devices, it should be understood that the concepts can also be used for devices such as venting tubes, catheters, drainage tubes, and the like.

In some embodiments, the external bumpers described herein are equipped with pressure sensors and pressure indicators that facilitate usage of the feeding tube devices within an appropriate range of skin surface pressure. In some embodiments, the external bumpers described herein are designed to exert an appropriate range of skin surface pressure when configured in a deflected, or spring-loaded state.

In some embodiments, one or more pressure sensor(s) can be attached to, or are embedded in, an external skin disk (a portion of the feeding tube that holds the tube in place, also referred to herein as an "external bumper"). The pressure sensor allows the user (i.e., patient and/or care provider) to adjust the external skin disk to a target range of pressure. When external skin disks have inadequate pressure, there is an increased risk of leakage (gastric/intestinal content, tube feeding, medication, etc.). Conversely, when external skin disks have excessive pressure, there is an increased risk of both internal and external skin irritation/breakdown/infection and an increased prevalence of tube compromise (malposition, compression, obstruction, etc.). Both inadequate and excessive pressure can increase associated tube costs (e.g., tube checks, tube replacements, clinical care access, etc.) and reduce quality of life for patients.

As described further below, in some embodiments the user will press a button to turn on the device and an indicator system consisting of LEDs will light in correspondence to the measured pressure that is being exerted on the skin. The indicator system (e.g., a blue LED for insufficient pressure, a green LED for acceptable pressure, and a red LED for excessive pressure) alerts the patient or caregiver to whether the feeding tube needs to be adjusted, and manual adjustments can then be made.

In some embodiments, the devices provided herein will also identify the presence of moisture, allowing for early identification of gastric/intestinal leakage. Further, in some embodiments the devices provided herein will communicate pressure and moisture measurements via wireless technology, allowing for real-time remote monitoring of pressure measurements.

In some embodiments, the external bumpers provided herein are designed to exert a desired level of pressure to the skin surface when deflectable elements of the external bumpers are pre-loaded by elastic deformation.

Figure 1:
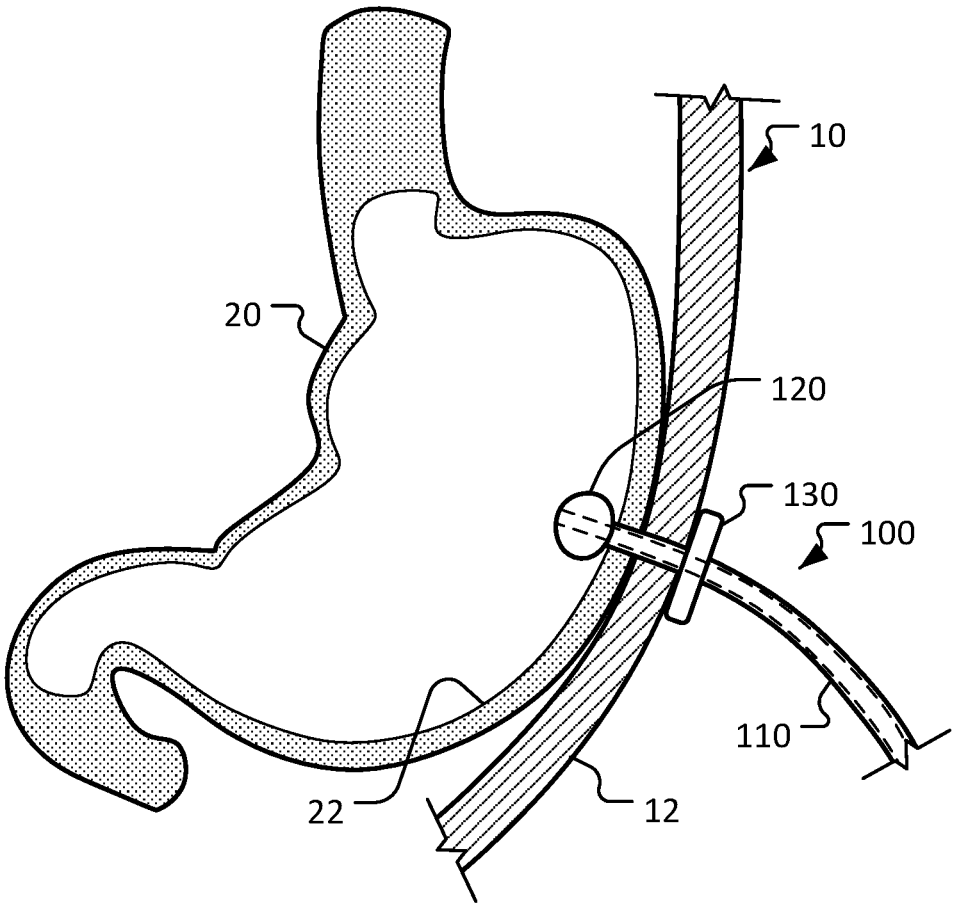
FIG. 1 shows a percutaneous endoscopic gastrostomy tube installed in a patient to provide a feeding conduit direct to the patient's stomach.

Referring to FIG. 1, an example percutaneous endoscopic gastrostomy (PEG) tube 100 is installed through an abdominal wall 10 such that a distal end portion of the PEG tube 100 is disposed within a stomach 20. In some cases, the distal end portion of PEG tube 100 is disposed within an intestine. Nutrients and/or medicaments can be supplied to stomach 20 via a longitudinal lumen defined by PEG tube 100. In some embodiments, PEG tube 100 includes a connector coupled to a proximal end of PEG tube 100 that is arranged to connect with a source of nutrition, hydration, and/or medication.

PEG tube 100 includes an elongate tube 110, a bulbous inner bumper 120 and an outer bumper 130. Inner bumper 120 is disposed around a distal end portion of tube 110 and configured for contact with a tissue surface of a gastrointestinal system (e.g., an inner wall surface 22 of stomach 20). Outer bumper 130 is slidably coupled to tube 110 and disposed between inner bumper 120 and a proximal of tube 110 (e.g., where a connector can be coupled). Outer bumper 130 is configured for contact with an abdominal skin surface 12. In some embodiments, as described further below, outer bumper 130 comprises one or more pressure sensors for detecting pressure exerted by outer bumper 130 onto abdominal skin surface 12.

In some embodiments, inner bumper 120 is inflatable. In such a case, the insertion of PEG tube 100 through abdominal wall 10 can be performed through a smaller incision (because inner bumper 120 can be deflated during insertion).

Figure 2:
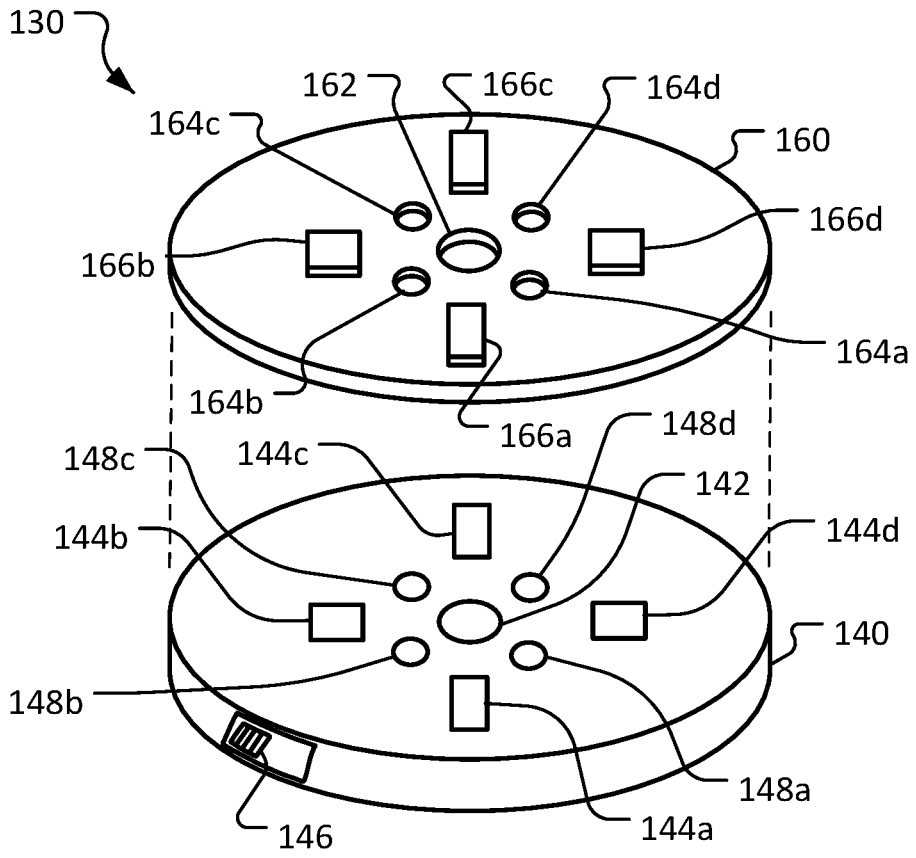
FIG. 2 is an exploded perspective view of an example outer bumper of a percutaneous endoscopic gastrostomy tube device in accordance with some embodiments provided herein.

Referring to FIG. 2, outer bumper 130 can be used as the external bumper of a feeding tube, and it can be conveniently integrated with feeding tubes of all sizes. In some cases, outer bumper 130 is provided to a clinician or patient as an existing component of a PEG tube device (e.g., PEG tube 100 described above). In some cases, outer bumper 130 is provided to a user as a discrete device that can be installed by a clinician or patient on a feeding tube as desired.

Outer bumper 130 includes a housing 140. Housing 140 defines an internal space and a through-hole 142 configured to slidably receive a feeding tube (e.g., elongate tube 110 described above). In some embodiments, through-hole 142 is adjustable in diameter. In various embodiments, through-hole 142 can include a locking mechanism by which outer bumper 130 can be releasably locked in place on the feeding tube.

Control circuitry (as described further below) can be disposed within the internal space defined by housing 140. In some embodiments, housing 140 is made of silicone, such as a medical-grade silicone. In some embodiments, housing 140 is made of one or more other types of molded plastic including, but not limited to, polystyrene, acrylonitrile butadiene styrene, polyvinyl chloride, polyethylene, high density polyethylene, low density polyethylene, polypropylene, polycarbonate, polyphenelyne ether, polyamide (PA or Nylon), ultra high molecular weight polyethylene, polyimide, polyetherimide, polyphenylene sulfide, polyetheretherketone, thermoplastic copolyether (PEBAX), and Fluorinated Ethylene Propylene.

In some embodiments, outer bumper 130 includes one or more pressure sensors. For example, in the depicted embodiment four pressure sensors 144*a*, 144*b*, 144*c*, and 144*d* are included. In some embodiments, one, two, three, five, six, seven, eight, nine, ten, or more than ten pressure sensors are included.

Pressure sensors 144*a*, 144*b*, 144*c*, and 144*d* are mounted on housing 140 and electrically coupled to the control circuitry disposed within housing 140. In some embodiments, pressure sensors 144*a*, 144*b*, 144*c*, and 144*d* can be various types of pressure sensors such as, but not limited to, force-sensitive resistors (FSRs), strain gauge sensors, piezoresistive integrated semiconductors (e.g., using piezoresistive silicon MEMS technology), capacitive pressure sensors, and the like. Pressure sensors 144*a*, 144*b*, 144*c*, and 144*d* are configured for detecting pressure exerted by outer bumper 130 onto an abdominal skin surface.

Outer bumper 130 can also include a power switch 146 for activating and deactivating the control circuitry disposed within housing 140. In some embodiments, power switch 146 is a button. In the depicted embodiment, power switch 146 is a sliding switch. In some embodiments, a power indicator light is included to indicate whether power switch 146 is activated or not.

In some embodiments, outer bumper 130 includes one or more moisture sensors. For example, in the depicted embodiment four moisture sensors 148*a*, 148*b*, 148*c*, and 148*d* are included. In some embodiments, one, two, three, five, six, seven, eight, nine, ten, or more than ten moisture sensors are included.

Moisture sensors 148*a*, 148*b*, 148*c*, and 148*d* can be configured to identify the presence of moisture, allowing for early identification of gastric/intestinal leakage. In some embodiments, moisture sensors 148*a*, 148*b*, 148*c*, and 148*d* are conductivity detectors.

In some embodiments, outer bumper 130 includes a layer of silicone material 160 covering a portion of housing 140 and configured for contact with the abdominal skin surface. Such a layer can provide enhanced patient comfort in some cases. Silicone material layer 160 can be bonded onto housing 140 in some embodiments. In the depicted embodiment, silicone material layer 160 defines a central through-hole 162 that corresponds with through-hole 142 of housing 140. Additionally, in some embodiments silicone material layer 160 defines clearance holes 164*a*, 164*b*, 164*c*, and 164*d* that provide openings through silicone material layer 160 for moisture sensors 148*a*, 148*b*, 148*c*, and 148*d*. Hence, silicone material layer 160 does not block moisture sensors 148*a*, 148*b*, 148*c*, and 148*d* from coming into contact with moisture from the skin surface.

In some embodiments, outer bumper 130 includes pad-like projections that correspond with the locations of pressure sensors. For example, in the depicted embodiment four projections 166*a*, 166*b*, 166*c*, and 166*d* are included to correspond with the locations of pressure sensors 144*a*, 144*b*, 144*c*, and 144*d*. The inclusion of projections 166*a*, 166*b*, 166*c*, and 166*d* can increase patient comfort in some cases (as compared, for example, to a totally flat silicone material layer 160). In addition, projections 166*a*, 166*b*, 166*c*, and 166*d* can provide a means of force propagation from the skin surface to the pressure sensors 144*a*, 144*b*, 144*c*, and 144*d*.

Figure 3:
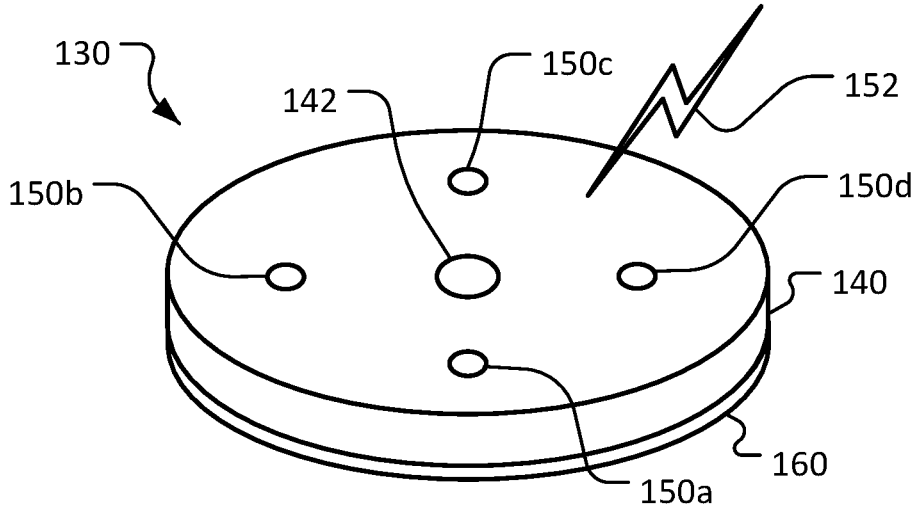
FIG. 3 is another perspective view of the percutaneous endoscopic gastrostomy tube outer bumper of FIG. 2.

Referring also to FIG. 3, in some embodiments the outward facing side of outer bumper 130 includes one or more indicators. For example, in the depicted embodiment the outer bumper 130 includes four indicators 150*a*, 150*b*, 150*c*, and 150*d*. Each respective indicator of indicators 150*a*, 150*b*, 150*c*, and 150*d* is configured for indicating a pressure detected by a respective pressure sensor 144*a*, 144*b*, 144*c*, and 144*d*. In one such example, indicators 150*a*, 150*b*, 150*c*, and 150*d* each comprise a light source, such as one or more LEDs.

In some embodiments, LED indicators 150*a*, 150*b*, 150*c*, and 150*d* are configured to indicate one or more of a high pressure, a low pressure, and a pressure within a target range. For example, in some embodiments the user will activate power switch 146 to turn on outer bumper 130, and then LED indicators 150*a*, 150*b*, 150*c*, and 150*d* will light up in correspondence to the measured pressure that is being exerted on the skin. In some cases, the indicator system can provide differentiated illumination (e.g., a blue LED light for insufficient pressure, a green LED light for acceptable pressure, and a red LED light for excessive pressure) to alert the patient or caregiver to whether the feeding tube needs to be adjusted, and manual adjustments can then be made. That is, while the individual indicators 150*a*, 150*b*, 150*c*, and 150*d* are green, the pressures detected by the individual corresponding pressure sensors 144*a*, 144*b*, 144*c*, and 144*d* are all within a target range of pressure. Conversely, if one or more individual pressure sensors of pressure sensors 144*a*, 144*b*, 144*c*, and 144*d* detect a pressure between outer bumper 130 and the adjacent skin surface that is either above or below the target range, the corresponding individual indicator 150*a*, 150*b*, 150*c*, and/or 150*d* will illuminate either red or blue respectively.

It should be understood that the colors of the above example are merely illustrative. Moreover, other types of indicators besides colored lights can be used such as, but not limited to, one or more graphical scales, flashing lights, warning tones, tactile feedback, a graphical display (e.g., LCD) and the like, and combinations thereof.

In some embodiments, outer bumper 130 includes a transmitter or transceiver for wireless communications with an external computing system (e.g., smart phone, tablet computer, laptop computer, modem, and the like) as represented by wireless signal symbol 152. Various modes and protocols of wireless communication can be used such as, but not limited to, WiFi, GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such wireless communication may occur, for example, through a transceiver using a radio-frequency. Alternatively, or in addition, short-range communication may occur between outer bumper 130 and an external computing system, such as by using Bluetooth, WiFi, RFID, ANT+, NFC, and the like.

Figure 4:
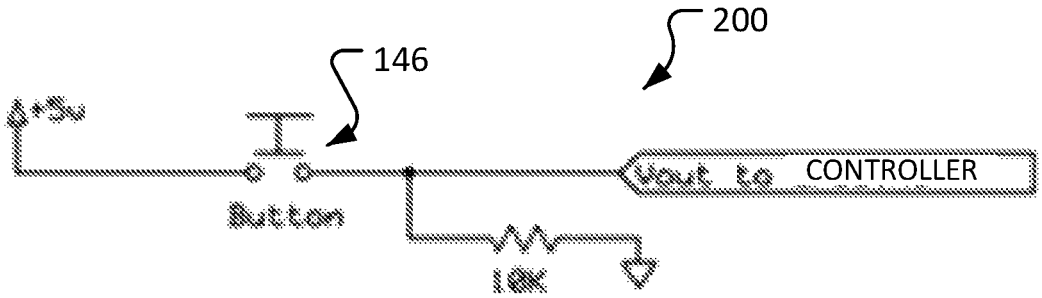
FIGS. 4-6 are electrical schematics of example circuits that can be incorporated into the percutaneous endoscopic gastrostomy tube outer bumpers provided herein.
Figure 5:
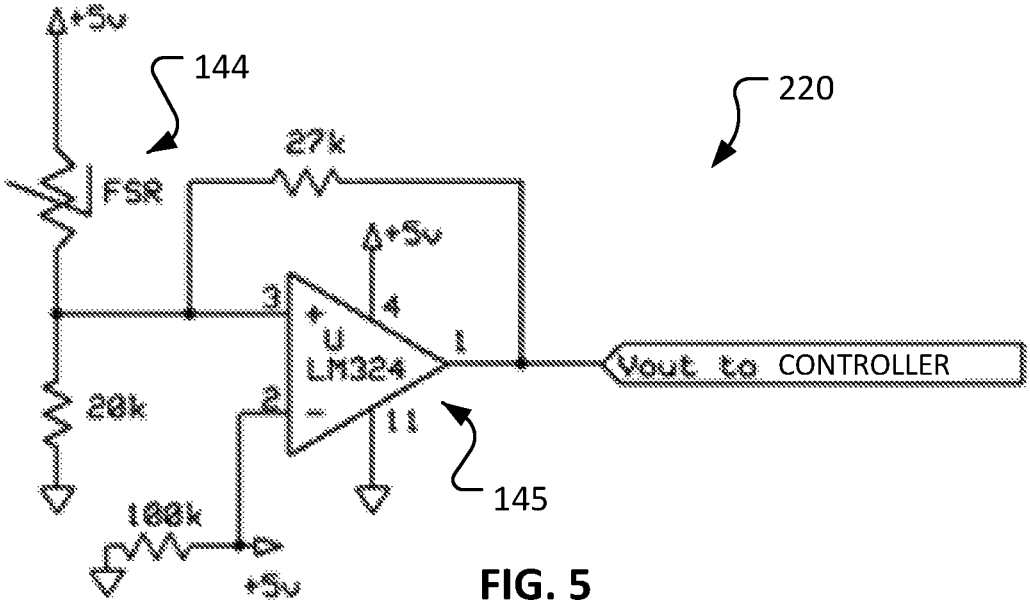
Figure 6:
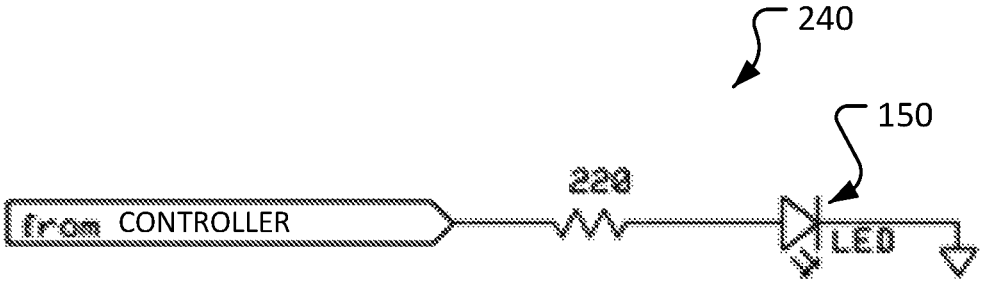

Referring also to FIGS. 4-6, outer bumper 130 can include electrical circuitry and one or more microprocessors. In some embodiments, the control circuitry disposed in housing 140 may be implemented a combination of one or more circuits, processor(s), and computer-readable memory (which may optionally store executable instructions configured to perform the sensing and logical determination operations described herein). The processor(s) are suitable for the execution of one or more computer programs and include, by way of example, both general and special purpose microprocessors, and any one or more processors of any kind of digital computer. The processor(s) can execute instructions, including the executable instructions that are stored in the memory. The processor(s) may be implemented as a chip or a chipset that may include separate and multiple analog and digital processors.

The executable instructions for operating outer bumper 130 can be stored in the memory, the expansion memory, memory on the processor, or in a combination thereof. The executable instructions can include instructions that, when executed, perform functions related to the operating systems of outer bumper 130 (e.g., operations of the pressure sensors, moisture sensor, indicators, coordination of intra-device module communications, coordination and control of other applications run by outer bumper 130, and so on). In addition, in some embodiments the executable instructions include instructions that, when executed, perform one or more of the functions and methods described elsewhere herein in relation to pressure and/or moisture parameter monitoring, analysis of the monitored parametric data, alarming, and communications with other devices and systems. In some implementations, the executable instructions, or portions thereof, can be received in a propagated signal, for example, via wireless communication 152.

FIG. 4 shows an example electrical circuit 200 that can be used in conjunction with power switch 146. For example, activation of power switch 146 can send a 5 volt signal to the microprocessor of outer bumper 130 or to another circuit within outer bumper 130.

FIG. 5 shows an example electrical circuit 220 that can be used in conjunction with a force sensitive resistor 144 (e.g. pressure sensors 144*a*, 144*b*, 144*c*, and 144*d*). For example, force sensitive resistor 144 can be wired as an input to an op amp 145 so as to detect when a force is above or below a threshold value. The values of the resistors used in electrical circuit 220 can be adjusted as needed to provide the appropriate cut off values.

FIG. 6 shows an example electrical circuit 240 that can be used in conjunction with an LED 150 (e.g., indicators 150*a*, 150*b*, 150*c*, and 150*d*). For example, the controller circuit can selectively output a voltage to illuminate LED 150.

Figure 7:
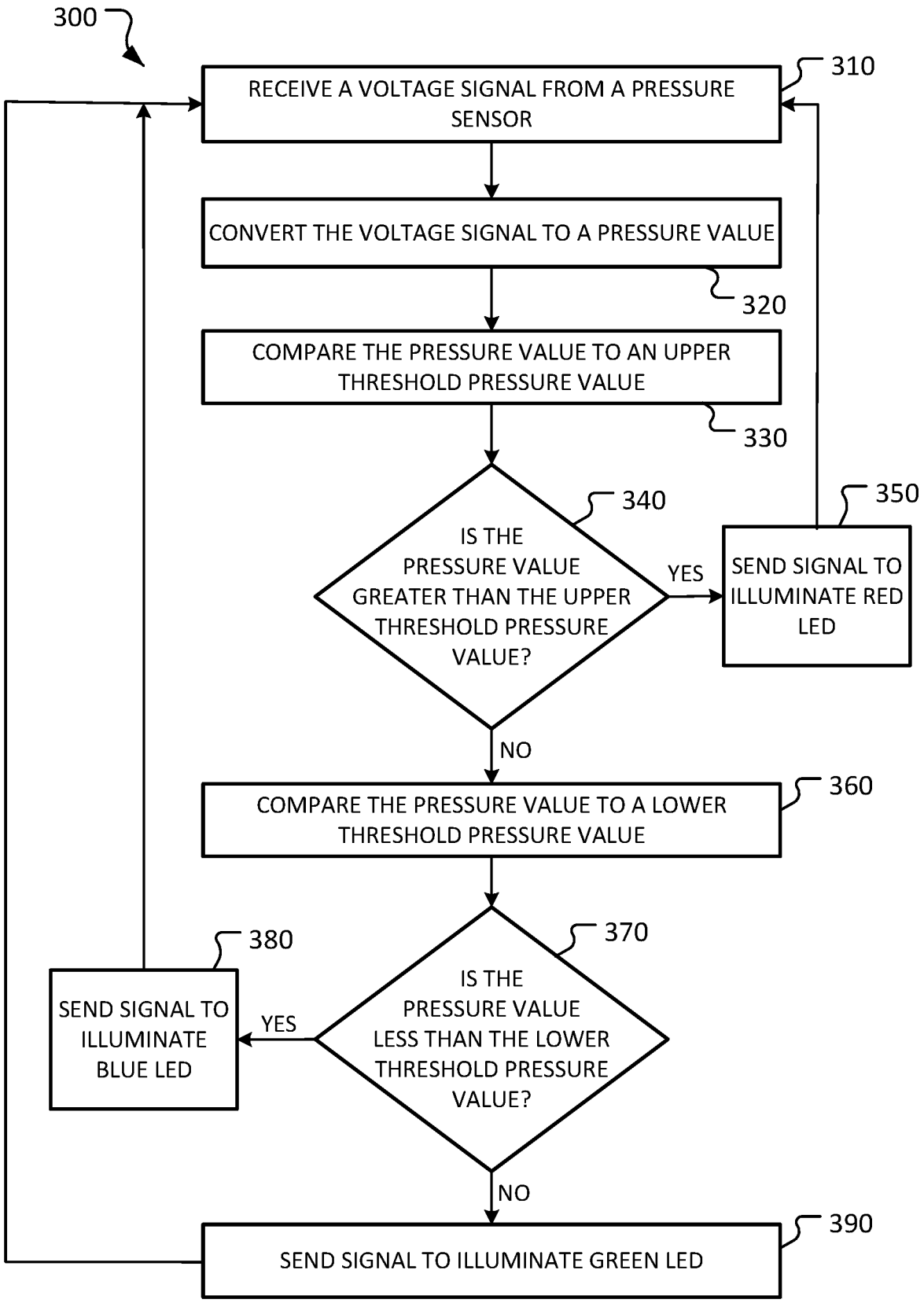
FIG. 7 is a flowchart of a method of operating a percutaneous feeding tube device in accordance with some embodiments provided herein.

Referring to FIG. 7, a flowchart illustrates an example method 300 of operating a percutaneous feeding tube device in accordance with some embodiments provided herein. For example, method 300 can be used to operate the example PEG tube 100 (including outer bumper 130) as described above. It should be understood that modifications to and deviations from method 300 can be implemented without departing from the spirit of the inventive disclosure of method 300. Method 300 can be performed by control circuitry housed in the outer bumper 130. The steps of method 300 can be performed using hardware, software, or a combination of both. Method 300 can be performed by the control circuitry on an on-going basis, or on a periodic basis (every 1 second, 5 seconds, 10 seconds, 30 seconds, 1 minute, and the like).

At step 310, the control circuitry of the outer bumper receives a voltage signal from a pressure sensor. It should be understood that, in some embodiments, the control circuitry will receive a voltage signal from multiple pressure sensors corresponding to different regions of the outer bumper.

At step 320, the voltage signal is converted to a pressure value. The conversion can be made using hardware, software, or a combination of both.

At step 330, the pressure value from step 320 is compared to an upper threshold pressure value. Again, the comparison can be made using hardware, software, or a combination of both.

At step 340, method 300 diverts to one of two directions depending on whether the comparison made in step 330 indicated that the pressure value was greater than the upper threshold pressure value or not. If the pressure value was greater than the upper threshold pressure value, the method proceeds to step 350. At step 350, the control circuitry of the outer bumper sends a signal to illuminate a red LED (indicating high pressure). In some embodiments, other types of indications can be initiated that correspond to a high-pressure status. After step 350, the method 300 repeats by reverting to step 310. If the pressure value was less than the upper threshold pressure value, the method proceeds to step 360.

At step 360, the pressure value from step 320 is compared to lower threshold pressure value.

At step 370, method 300 diverts to one of two directions depending on whether the comparison made in step 360 indicated that the pressure value was less than the lower threshold pressure value or not. If the pressure value was less than the lower threshold pressure value, the method proceeds to step 380. At step 380, the control circuitry of the outer bumper sends a signal to illuminate a blue LED (indicating low pressure). In some embodiments, other types of indications can be initiated that correspond to a low-pressure status. After step 380, the method 300 repeats by reverting to step 310. If the pressure value was greater than the lower threshold pressure value, the method proceeds to step 390.

At step 390, the control circuitry of the outer bumper sends a signal to illuminate a green LED (indicating a pressure that is within a target range). In some embodiments, other types of indications can be initiated that correspond to a within target range status. After step 390, the method 300 repeats by reverting to step 310.

Figure 8:
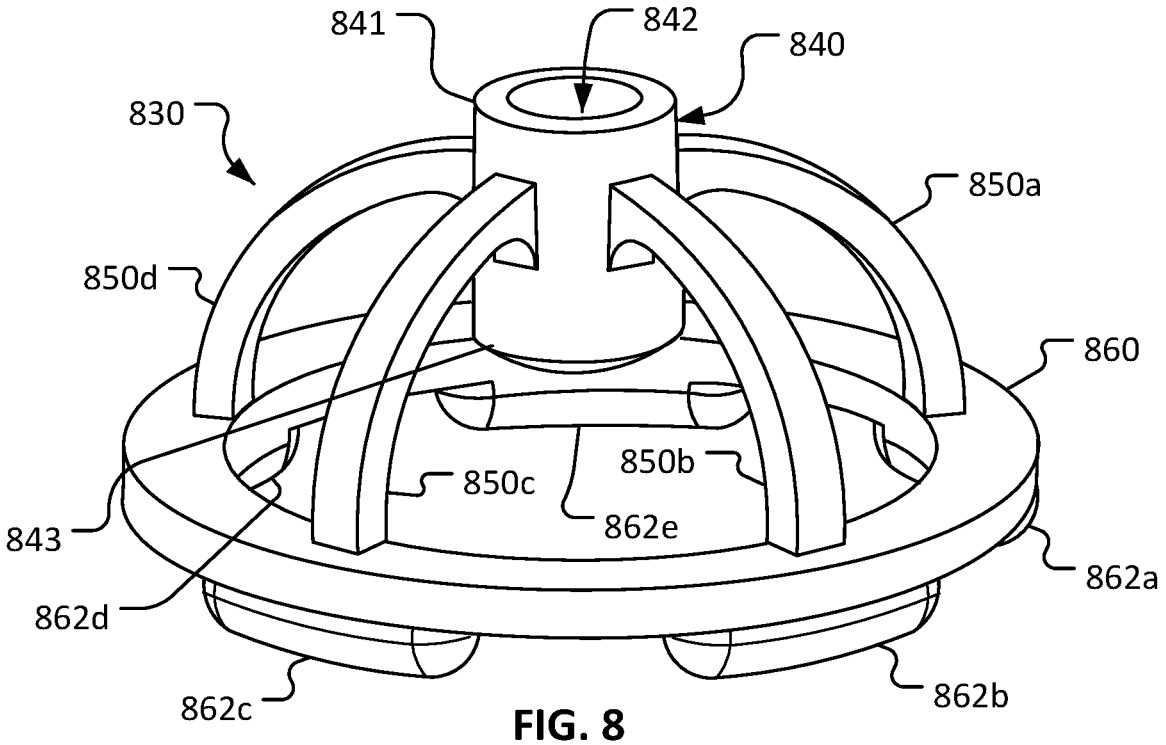
FIG. 8 is a perspective view of another example external outer bumper of a percutaneous endoscopic gastrostomy tube device in accordance with some embodiments provided herein.

Referring to FIG. 8, another example outer bumper 830 can be used as the external bumper of a feeding tube, and it can be conveniently integrated with feeding tubes of all sizes. In some cases, outer bumper 830 is provided to a clinician or patient as an existing component of a PEG tube device (e.g., PEG tube 100 described above). In some cases, outer bumper 830 is provided to a user as a discrete device that can be installed by a clinician or patient on a feeding tube as desired.

Outer bumper 830 includes a central collar 840, deflectable elements 850*a-e*, outer rim 860, and pads 862*a-e*. Deflectable elements 850*a-e* extend between and interconnect central collar 840 and rim 860.

Outer bumper 830 can be made of various polymeric materials such as, but not limited to, medical grade silicone rubbers. For example, in some embodiments outer bumper 830 is made of DOW CORNING® QP1-250 Medical Grade silicone rubber marketed by Dow Corning Corporation of Midland, Mich. In some embodiments, the entirety of outer bumper 830 is made of a single type of material. In particular embodiments, outer bumper 830 is made of a combination of two or more types of materials. In some embodiments, outer bumper 830 is molded as a unitary component using a liquid silicone rubber mold (LSR mold) process. In some embodiments, one or more other manufacturing processes can be used such as, but not limited to, injection molding, insert molding, overmolding, and secondary processing.

Central collar 840 defines a through hole 842 which is configured to receive a feeding tube. In some embodiments, the fit between the inner diameter of through hole 842 and the outer diameter of the tube can be a slight interference fit or a slight clearance fit. In some embodiments, a releasable locking mechanism can be included on central collar 840 so that central collar 840 can be detained on a particular portion of the feeding tube.

Pads 862*a-e* are attached to and extend distally from outer rim 860. Skin contact between outer bumper 830 and the patient is at least existing at the distal ends of pads 862*a-e*. In the depicted embodiment, pads 862*a-e* are spaced apart from each other. The spaces between adjacent pads 862*a-e* advantageously allows for airflow and skin cleaning. In addition, the spaced between adjacent pads 862*a-e* allows the patient to rotate outer rim 860 as desired to change the portions of skin that are in contact with pads 862*a-e* to minimize skin irritation.

While in the depicted embodiment there are five pads 862*a-e*, in some embodiments two, three, four, six, seven, eight, or more than eight pads are included.

Deflectable elements 850*a-e* extend between and interconnect central collar 840 and rim 860. Deflectable elements 850*a-e* are designed to be relatively slender to provide suitable compliance and elasticity (for the reasons described further below). Deflectable elements 850*a-e* extend distally from central collar 840 and terminate at their distal ends at rim 860. While in the depicted embodiment there are five deflectable elements 850*a-e*, in some embodiments two, three, four, six, seven, eight, or more than eight deflectable elements are included.

In some embodiments (such as the depicted embodiment), deflectable elements 850*a-e* are shaped as curved members. In particular embodiments, deflectable elements 850*a-e* are shaped as compound curves (i.e., a curve made up of two or more circular arcs of successively shorter or longer radii, joined tangentially without reversal of curvature).

Referring again to central collar 840, central collar 840 has a proximal collar end 841 and a distal collar end 843. While outer bumper 830 is in its natural, un-deflected state (as shown in FIG. 8), distal collar end 843 is proximally spaced apart from the skin-contacting distal ends of pads 862*a-e*. Accordingly, if outer bumper 830 is compressed by forcing central collar 840 distally towards outer rim 860, deflection of deflectable elements 850 a-e can take place until distal collar end 843 comes into skin contact like the distal ends of pads 862*a-e*. When such compression takes place, deflectable elements 850 a-e elastically deflect (bend) like simply-supported beams.

In some embodiments, the distance that central collar 840 can be moved is about 5 mm. Said differently, in some embodiments while outer bumper 830 is in its natural un-deflected state (as shown in FIG. 8) the distance between distal collar end 843 and the skin-contacting distal ends of pads 862*a-e* is about 5 mm. In some embodiments, the distance is in a range of about 4 mm to about 6 mm, or about 3 mm to about 7 mm, or about 2 mm to about 8 mm, or about 4 mm to about 8 mm, or about 5 mm to about 10 mm, or about 5 mm to about 15 mm.

Figure 10:
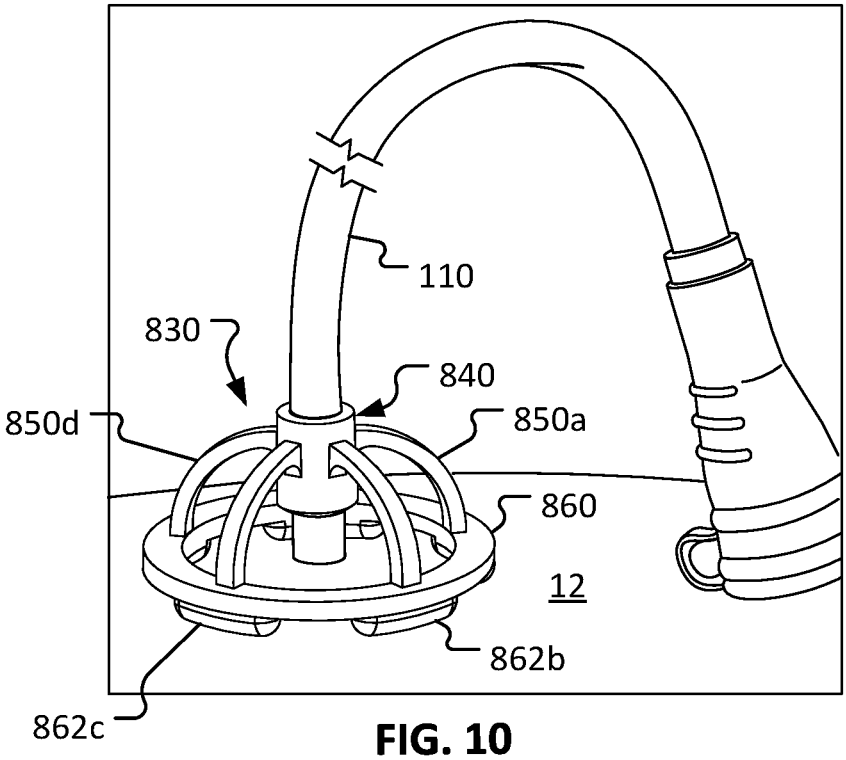
FIGS. 10 and 11 show how a percutaneous endoscopic gastrostomy tube device having the external outer bumper of FIG. 8 can be used on a patient.

Referring also to FIG. 10, in preparation for use, outer bumper 830 (which is slidably coupled with a tube 110) is first positioned to be lightly in contact with skin surface 12 (i.e., with very little pressure being applied by pads 862*a-e* to skin surface 12). In this configuration, deflectable elements 850*a-e* are not deflected from their natural un-deflected state. The user can lightly pull proximally on tube 110 to position inner bumper 120 as desired (e.g., abutting against the inner wall surface 22 of stomach 20 as depicted in FIG. 1), while pads 862*a-e* are lightly in contact with skin surface 12.

Figure 11:
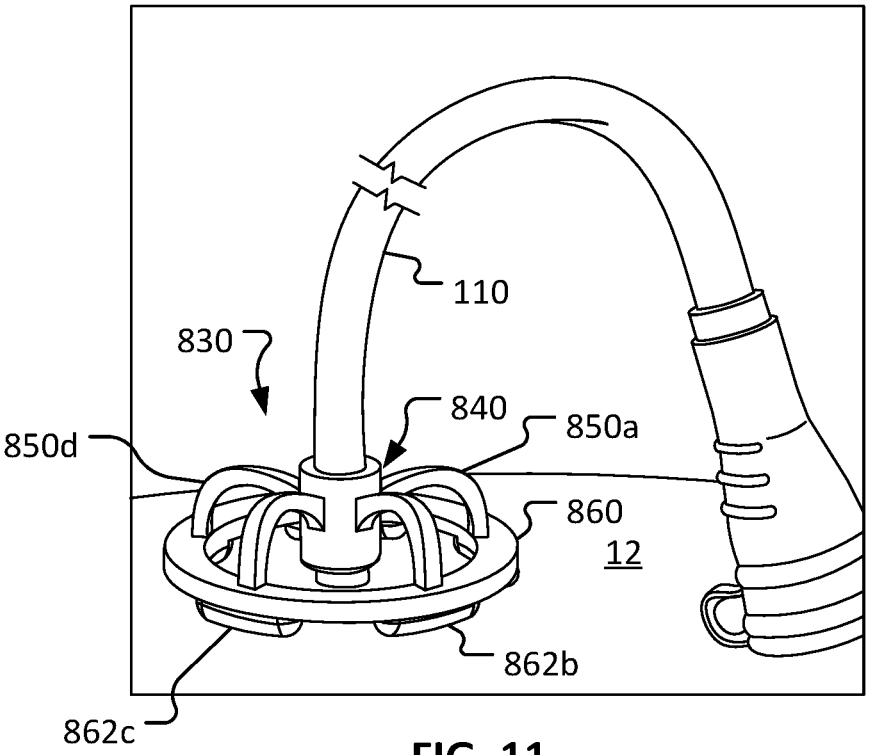

Then, as depicted in FIG. 11, in order to increase the amount of force applied by outer bumper 830 against skin surface 12 to a desired level, the user can push central collar 840 toward skin surface 12 while simultaneously holding tube 110 stationary. That is, as the user presses central collar 840 toward skin surface 12, the user also holds tube 110 stationary such that central collar 840 slides along tube 110.

As central collar 840 slides along tube 110, deflectable elements 850*a-e* bend to a greater extent than their naturally curved, but otherwise un-deflected state (as shown in FIG. 8). Distal collar end 843 can be positioned where it is abutting or close to abutting skin surface 12. Then, when the user releases central collar 840, friction between central collar 840 and tube 110 maintains the deflectable elements 850*a-e* in their deflected state (as shown in FIG. 11). The stress residing in deflectable elements 850*a-e* is transferred to skin surface 12 via outer rim 860 and pads 862*a-e*. Accordingly, by virtue of the bent configuration of deflectable elements 850*a-e*, outer bumper 830 tensions tube 110 to an appropriate, targeted level such that inner bumper 120 is held in a desired position (to avoid leaks) while not over tensioning tube 110 so as to risk internal and/or external skin irritation/breakdown/infection or an increased prevalence of tube compromise (malposition, compression, obstruction, etc.).

Deflectable elements 850*a-e* are designed such that, while distal collar end 843 is abutting or close to abutting skin surface 12 (as shown in FIG. 11), a targeted about 40 grams to about 150 grams of force is applied by outer bumper 830 to skin surface 12. Various factors regarding deflectable elements 850*a-e* can be chosen to attain the desired amount of force. Such factors can include, but are not limited to, material type, number of deflectable elements, un-deflected curvature of the deflectable elements, moment of inertia of the deflectable elements, and so on.

In some embodiments, outer bumper 830 (and deflectable elements 850*a-e* in particular) is designed such that it exerts about 100 grams of force to skin surface 12 while distal collar end 843 is abutting or close to abutting skin surface 12. In some embodiments, the amount of force exerted is in a range of about 40 grams to about 80 grams, or about 60 grams to about 100 grams, or about 80 grams to about 120 grams, or about 100 grams to about 140 grams, or about 120 grams to about 160 grams, or about 140 grams to about 180 grams, or about 40 grams to about 150 grams.

Figure 9:
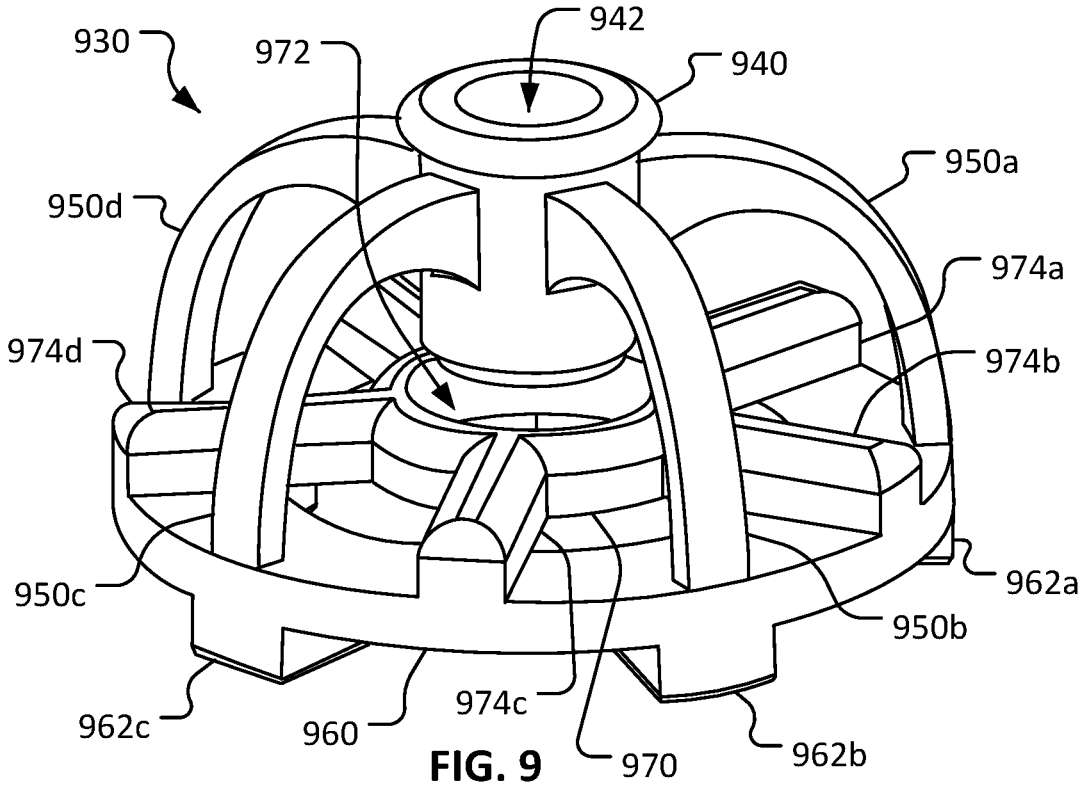
FIG. 9 is a perspective view of another example external outer bumper of a percutaneous endoscopic gastrostomy tube device in accordance with some embodiments provided herein.

Referring to FIG. 9, another example outer bumper 930 can be used as the external bumper of a feeding tube, and it can be conveniently integrated with feeding tubes of all sizes. In some cases, outer bumper 930 is provided to a clinician or patient as an existing component of a PEG tube device (e.g., PEG tube 100 described above). In some cases, outer bumper 930 is provided to a user as a discrete device that can be installed by a clinician or patient on a feeding tube as desired.

Outer bumper 930 includes a central collar 940, deflectable elements 950*a-e*, outer rim 960, and pads 962*a-e*. Deflectable elements 950*a-e* extend between and interconnect central collar 940 and rim 960. Deflectable elements 950*a-e* function like deflectable elements 850*a-e* described above in reference to outer bumper 830. Outer bumper 930 is analogous to outer bumper 830 except that outer bumper 930 includes spokes 974*a-e* that extend radially between outer rim 960 and a central ring 970. Central ring 970 defines an opening that loosely receives the outer diameter of central collar 940 when central collar 940 is pushed distally towards the pads 962*a-e*. Accordingly, central ring 970 provides a visual indication of the position of central collar 940 in relation to other portions of outer bumper such as the distal skin-contacting surfaces of pads 962*a-e*. In some embodiments, demarcations may be included on the outer surface of central collar 940, and central ring 970 can be used in combination with the demarcations to quantifiably gauge the position of central collar 940.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

While the inventive concepts are described herein in the context of feeding tube devices, it should be understood that the concepts can also be used for devices such as venting tubes, catheters, drainage tubes, and the like.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A percutaneous feeding tube device comprising:

an elongate tube;

a bulbous inner bumper disposed around a portion of the tube and configured for contact with a tissue surface of a gastrointestinal system;

a connector coupled to a proximal end of the tube; and an outer bumper slidably coupled to the tube and disposed between the inner bumper and the connector, the outer bumper configured for contact with an abdominal skin surface, wherein the outer bumper comprises one or more pressure sensors for detecting pressure exerted by the outer bumper onto the abdominal skin surface.

2. The device of claim 1, wherein the inner bumper is inflatable.

3. The device of claim 1, wherein the outer bumper further comprises a moisture detector.

4. The device of claim 1, wherein the outer bumper further comprises one or more indicators, and wherein each respective indicator of the one or more indicators is configured for indicating a pressure detected by a respective pressure sensor of the one or more pressure sensors.

5. The device of claim 4, wherein the one or more indicators each comprise a light source.

6. The device of claim 5, wherein the light source is configured to indicate one or more of a high pressure, a low pressure, and a pressure within a target range.

7. The device of claim 1, wherein the outer bumper further comprises a transmitter for wireless communications with an external computing system.

8. The device of claim 1, wherein the outer bumper further comprises a battery powered control circuit.

9. An outer bumper for a percutaneous feeding tube device, the outer bumper comprising:

a housing defining an internal space, the housing defining a through-hole configured to slidably receive a feeding tube;

control circuitry disposed within the internal space; and one or more pressure sensors coupled to the control circuitry for detecting pressure exerted by the outer bumper onto an abdominal skin surface.

10. The outer bumper of claim 9, further comprising a silicone layer covering a portion of the housing and configured for contact with the abdominal skin surface.

11. The outer bumper of claim 9, further comprising one or more indicators, wherein each respective indicator of the one or more indicators is configured for indicating a pressure detected by a respective pressure sensor of the one or more pressure sensors.

12. The outer bumper of claim 11, wherein the one or more indicators each comprise a light source.

13. The outer bumper of claim 12, wherein the light source is configured to indicate one or more of a high pressure, a low pressure, and a pressure within a target range.

14. The outer bumper of claim 9, wherein the outer bumper further comprises a transmitter for wireless communications with an external computing system.

15. The outer bumper of claim 9, further comprising a moisture detector.

* * * * *